US007334957B2

(12) United States Patent
Sadinsky et al.

(10) Patent No.: US 7,334,957 B2
(45) Date of Patent: Feb. 26, 2008

(54) PORTABLE PROTECTIVE FENCE AND METHOD OF INSTALLATION THEREOF

(75) Inventors: Steven E. Sadinsky, Van Nuys, CA (US); Blaine Hall, Coarsegold, CA (US)

(73) Assignee: Guardian Pool Fence Systems, Inc., Van Nuys, CA (US)

( * ) Notice: Subject to any disclaimer, the term of this patent is extended or adjusted under 35 U.S.C. 154(b) by 29 days.

(21) Appl. No.: 11/261,358

(22) Filed: Oct. 27, 2005

(65) Prior Publication Data

US 2007/0108428 A1 May 17, 2007

(51) Int. Cl.
*F16B 7/10* (2006.01)

(52) U.S. Cl. ..... 403/109.3; 403/109.7; 403/109.8

(58) Field of Classification Search ..... 256/65.14; 403/108–109.8

See application file for complete search history.

(56) References Cited

U.S. PATENT DOCUMENTS 4,247,216 A * 1/1981 Pansini ..... 403/109.3
6,213,672 B1 * 4/2001 Varga ..... 403/109.2
6,554,257 B1 * 4/2003 Kenton ..... 256/65.14

* cited by examiner

*Primary Examiner*—Daniel P. Stodola
*Assistant Examiner*—Victor MacArthur
(74) *Attorney, Agent, or Firm*—Christie, Parker & Hale, LLP.

(57) ABSTRACT

A lightweight fence or gate pole is provided having a lock assembly including a base attached to the lightweight pole, a support member extending from the base, a connector extending from the support member, the connector having a snap button connected thereto and a screw attached to the connector. The lock assembly has a locked position when a screw head is adjacent to an outer surface of the lightweight pole and the lock assembly has an unlocked position wherein the screw head is farther away from the outer surface of the lightweight pole than in the locked position.

10 Claims, 6 Drawing Sheets

PORTABLE PROTECTIVE FENCE AND METHOD OF INSTALLATION THEREOF

BACKGROUND OF THE INVENTION

In recent years, a need has been recognized for a type of swimming pool fence that is difficult for a small child to climb and is weather resistant, yet may be removed for uninterrupted use of the swimming pool. These fences employ a number of rigid or slightly flexible poles of steel, aluminum or fiberglass which are set in holes in a pool decking approximately two feet from the edge of the pool. The poles are located at approximately a 30-36 inch spacing.

Tensioned between the poles is a mesh screen having a binding top and bottom and sufficient tensile strength so that a person cannot easily enlarge the mesh openings to force a way through the fence. Further, there are no footholds or handholds for a child to climb the fence. The bound upper edge of the fence prevents fraying of the mesh, but does not provide a handhold or sufficient rigidity to aid a child to climb over the fence, even if the child can reach to the top of the fence. The instability of the top binding acts as a deterrent for the child even if he or she is able to reach the top of the fence.

The fence may be opened to allow swimmers to enter and leave the pool area by unlatching a section which acts as a gate, usually with a spring-loaded hook and eye fastener and then by lifting one pole out of its deck socket. The pole must be reinserted and the latch hooked for each entry and departure from the pool area. More elaborate gates have also been developed.

When the pool is used without the fence, each of the poles may be pulled in sequence from their socket and the fabric fencing material and poles are rolled to form a compact structure. Reassembly of the fence starts by inserting the first pole, hooking it to a rigid structure and extending each pole in the section in sequence to another rigid structure or back to the original pole to complete a closed circuit. Each section is then tensioned with a fastener connecting each fence section to the next section.

Recently, fences have been developed that allow the fence poles to be removably locked into a socket inserted into a pool deck hole. The locking feature allows the fence poles to be more securely maintained in the pool deck while still allowing the poles to be easily removed. On a conventional lockable fence, a release button is provided on the fence poles to allow a user to disengage the lock from the pole socket by merely pressing the button. Thus, ease and convenience of removal has been valued over security, and such fences are still considered removable and not "permanent." To be considered a "permanent" fence, building codes require that a tool be necessary to disassemble the fence. Thus, there is a need for a fence system that may be locked into a pool deck hole and may be released from the pool deck hole by using a tool yet still has a simple release mechanism.

SUMMARY OF THE INVENTION

A lightweight fence or gate pole is provided having a lock assembly including a base attached to the lightweight pole, a support member extending from the base, a connector extending from the support member, the connector having a snap button connected thereto and a screw attached to the connector. The lock assembly has a locked position when a screw head is adjacent to an outer surface of the lightweight pole and the lock assembly has an unlocked position wherein the screw head is farther away from the outer surface of the lightweight pole than in the locked position.

Additionally, a method is provided for removing the fence or gate pole from a socket in a lightweight fence for swimming pools surrounded by a deck. The method includes using a tool to rotate the screw on the pole such that the base of the screw is spaced from the base of the lock assembly, applying a force to the screw to cause the snap button to become flush with the outer surface of the fence pole, and disengaging the fence pole from the socket by pulling the fence pole out of the socket.

DETAILED DESCRIPTION

Figure 1:
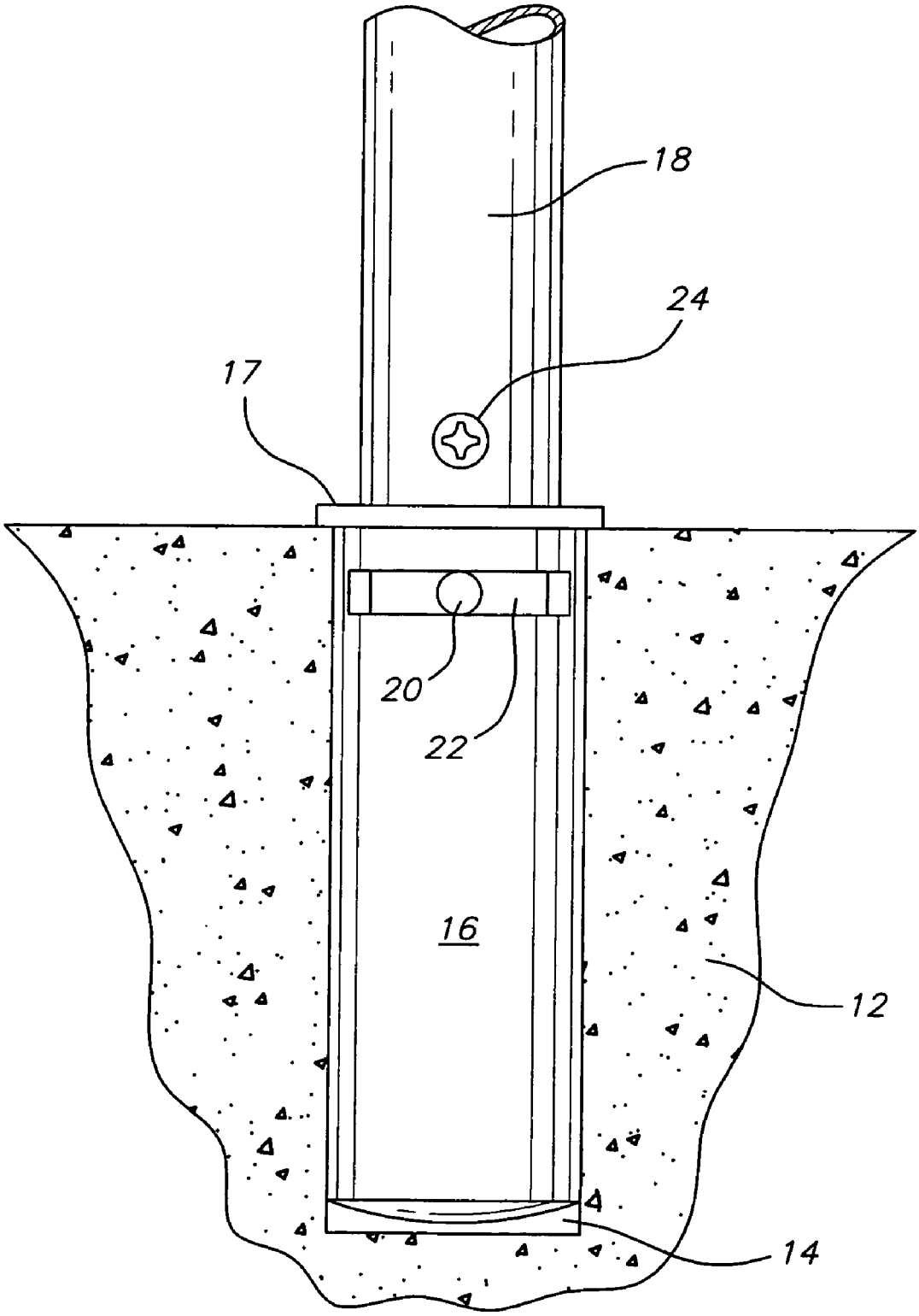
FIG. 1 is a partial cross-sectional view of an exemplary embodiment of a fence or gate pole assembly of the present invention.

Referring to FIG. 1, an exemplary embodiment of a fence or gate pole 18 of the present invention is shown inserted into a pool deck 12 having a pre-drilled hole 14. The hole 14 may be sized to snugly receive a socket 16. In one exemplary embodiment, the hole has a diameter of about 1.25 inches and a depth of about 4.25 inches. However, the specific dimensions of the hole 18 are not critical, and the hole may be dimensioned to receive any socket or fence pole.

The socket 16 insertable into the hole 14 may be, in one exemplary embodiment, cylindrical having a diameter of about 1.25 inches and a height of about 4.25 inches. The socket may be made from plastic, and more specifically, from high density polyethylene (HDPE). However, the socket material is not limited to those described herein and the socket 16 may be made from any sufficiently durable and rigid material. The socket may have a flange 17 at one end enabling the top end of the socket 16 to be rested on the pool deck surface. In one exemplary embodiment, the flange 17 extends about 1/16 inch from the outer diameter of the socket. The socket 16 includes a snap button receiving area 22 which may be machined into the socket or may be a section cut out of the socket wall. The snap button receiving area 22 is dimensioned to receive a snap button 20 as is described in more detail below. In one exemplary embodiment, the snap button receiving area 22 is substantially rectangular having a width of about 1 inch and a height of about 0.25 inch.

The present invention may also be used without a socket. In such an embodiment, the fence pole is received directly into the hole in the deck. A snap button receiving area is cut into the wall of the hole itself.

Figure 3:
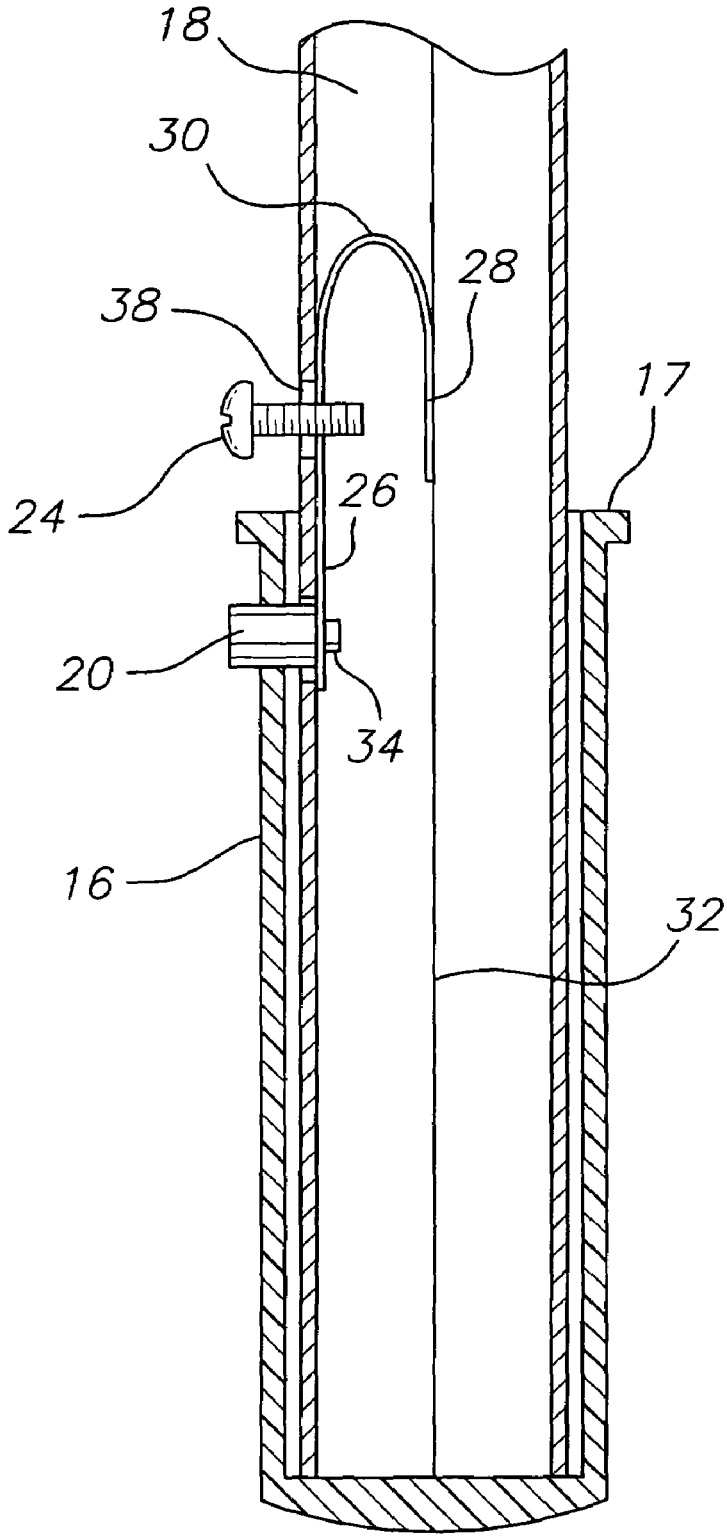
FIG. 3 is a side cross-sectional view of the fence pole and the lock assembly of FIG. 2 in an engaged state in an unlocked position.
Figure 4:
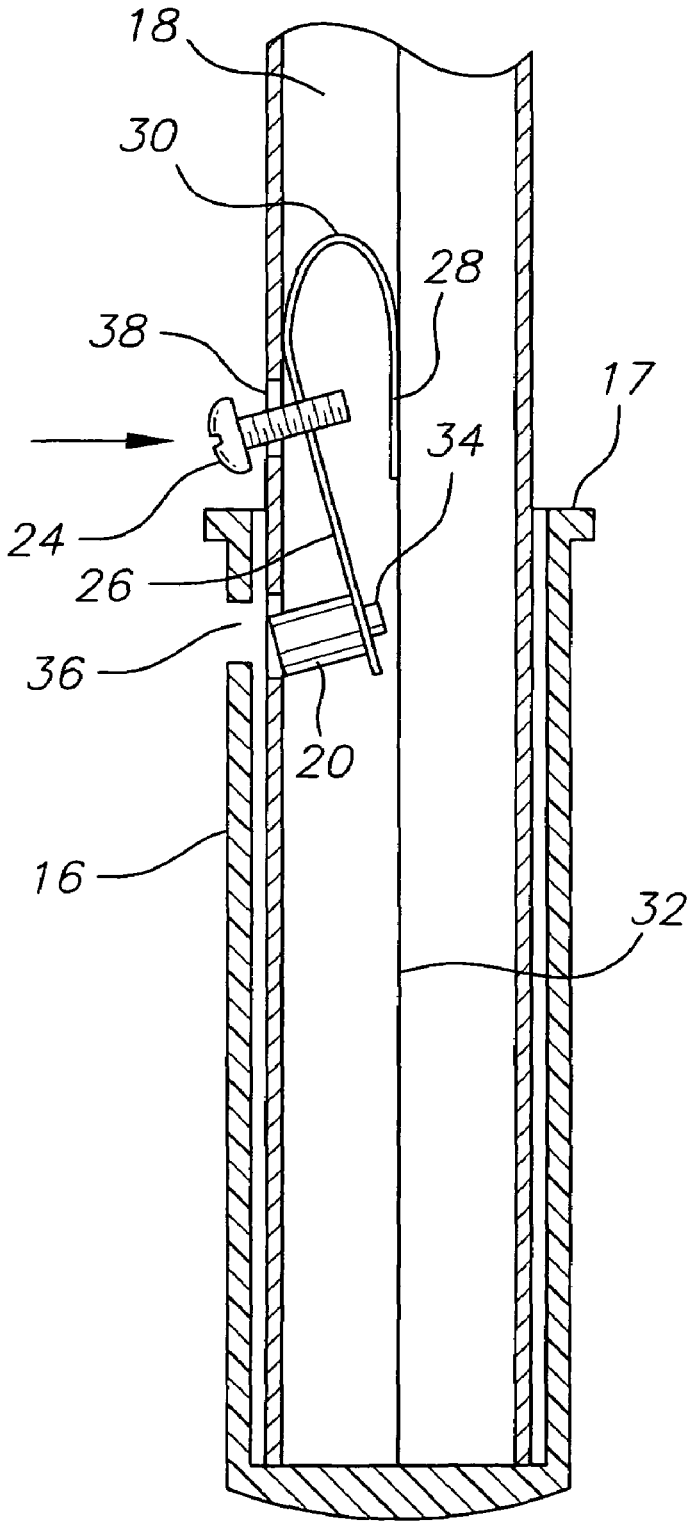
FIG. 4 is a side cross-sectional view of the fence pole and lock assembly of FIG. 2 in a disengaged state in an unlocked position.
Figure 5:
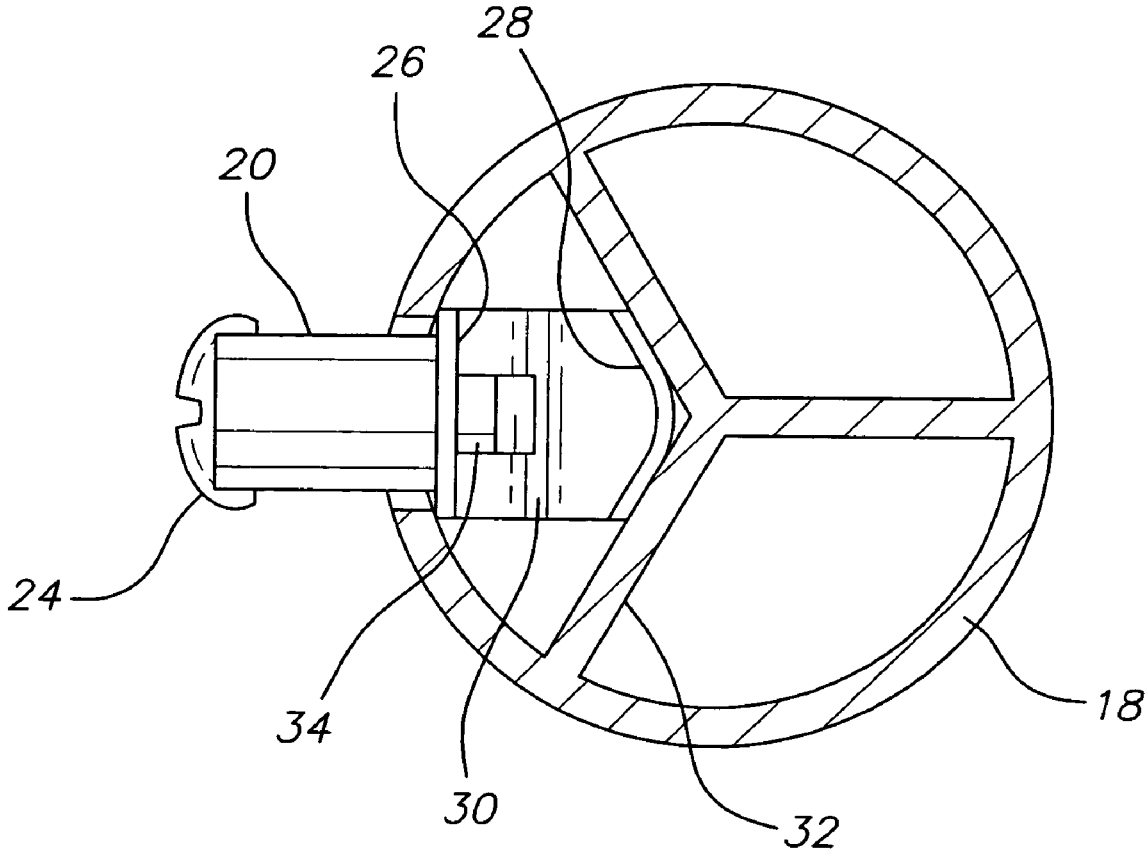
FIG. 5 is a cross-sectional view of the fence pole and lock assembly of FIG. 2 looking up along the longitudinal axis of the fence pole.
Figure 6:
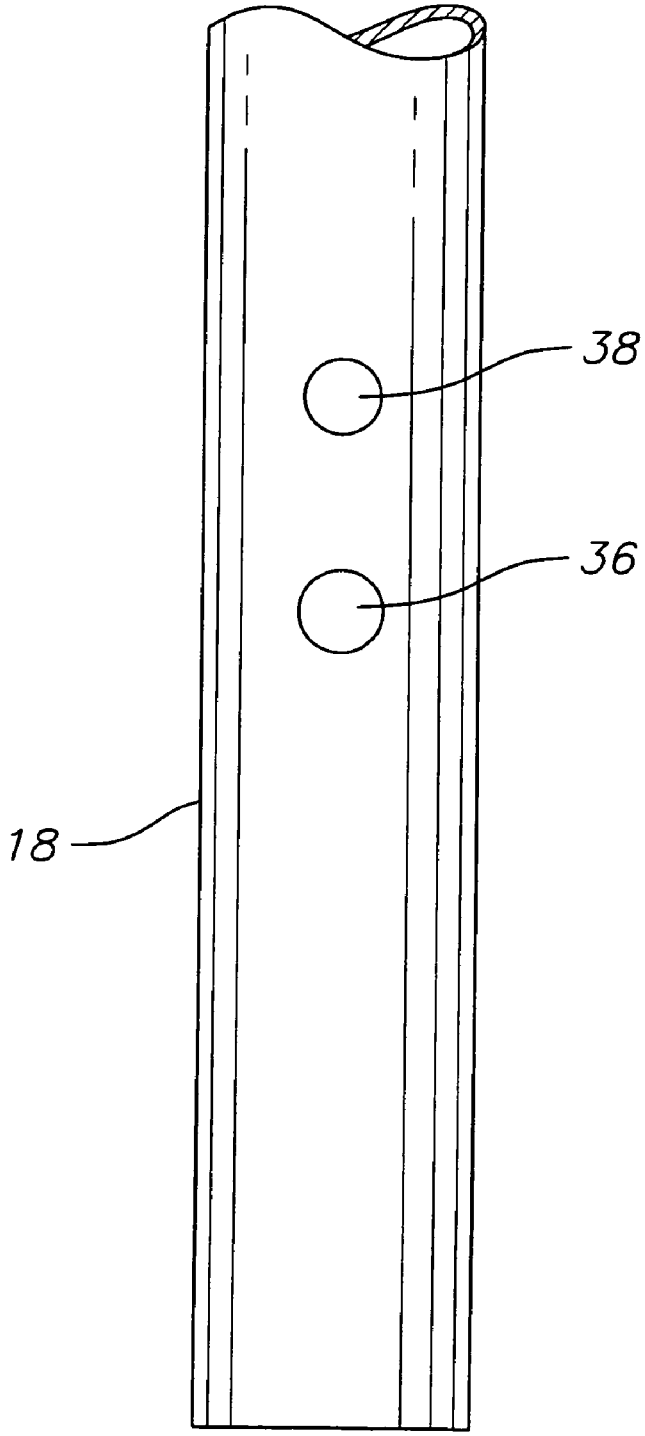
FIG. 6 is a partial view of a fence pole showing a snap button receiving hole and a screw receiving hole.

Referring to FIGS. 2-5, the fence pole 18 contains a lock assembly 19 including a base 28, a support member 30 and a connector 26. As shown in FIG. 5, the fence pole 18 may have three dividers 32 that provide additional support for the pole. However, the lock assembly 19 may be used in a fence pole having no dividers, one or two dividers, or more than three dividers. As shown in FIG. 6, the fence pole may also have a snap button receiving hole 36 adapted to receive the snap button 20 and a screw receiving hole 38 adapted to receive a screw 24 as is described in more detail below.

Figure 2:
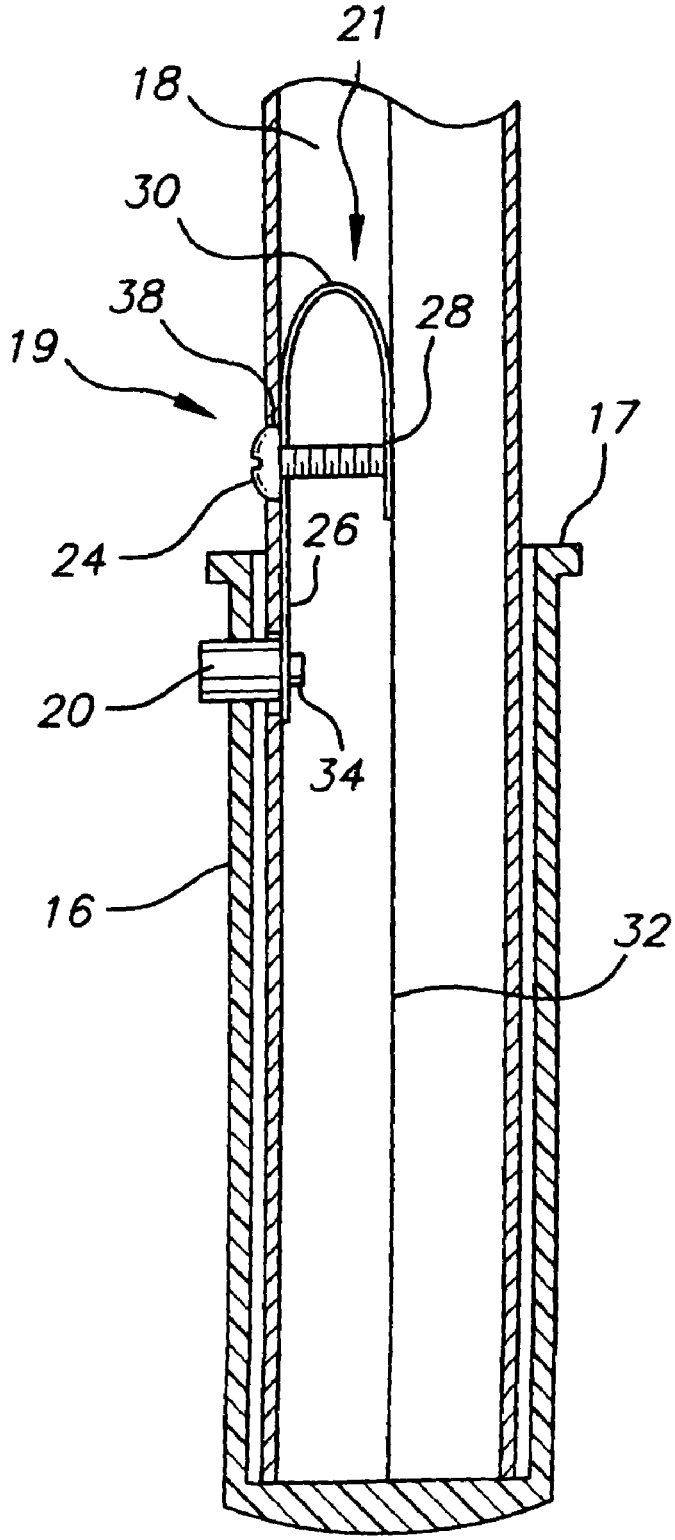
FIG. 2 is a side cross-sectional view of a fence pole and an exemplary lock assembly in a locked position.

The base 28 of the lock assembly 19 may be adapted to fit within the fence pole 18, and may be curved to rest on two dividers 32 as shown in FIG. 5, but the base is not limited to this specific shape. The base 28 may be fixedly attached to the dividers 32 by an adhesive or by any other means to sufficiently fix the base to the fence pole 18. The support member 30 extends substantially perpendicularly from one end of the base 28 and serves to support a connector 26 extending from the support member 30 as shown in FIGS. 2-4. The connector 26 has a first hole (not shown) adjacent an end opposite the end where the support member 30 is attached, the hole being adapted to receive a snap button 20 as is described in more detail below. The connector also has a second hole (not shown) more proximal to the support member 30 than the first hole, the second hole being adapted to receive a screw 24 as is described in more detail below. The base 28, the support member 30 and the connector 26 may all be machined or formed from the same piece of material, for example, stainless steel, and configured in a substantially U-shaped leaf spring as is shown in FIGS. 2-4. Alternately, the base 28, the support member 30 and the connector 26 may all be machined or formed individually and connected together by, for example, welding. Together, the components 26, 28, 30 form a supporting structure 21 and provide a means to bias the snap button away from the base. The components 26, 28, 30 may be composed of any durable, resilient material able to reliably bias the snap button.

The snap button 20 may be fixedly attached to the connector 26 by a rivet 34 inserted through the first hole in the connector. The snap button 20 is dimensioned such that it protrudes from the snap button receiving hole 38 on the fence pole 18 and into the snap button receiving area 22 on the socket enough to securely lock the fence pole 18 to the socket when the pole is placed into the socket. For example, the snap button 20 may protrude from the socket 16 by about 1/16 inch. However, the snap button 20 may have any dimensions which allow it to securely lock the fence pole 18 to the socket 16.

The screw 24 may be movably or threadably attached to the connector 26 through the second hole. When the screw 24 is turned in a first direction, for example, clockwise, the threads of the screw drive the screw toward the direction of the base 28. In contrast, when the screw 24 is turned in a second direction, for example, counterclockwise, the threads of the screw drive the screw in an opposite direction, away from the direction of the base 28. The screw may be rotated by using a tool, for example, a screwdriver or an Allen wrench.

The operation of the lock assembly 19 will now be described. In one exemplary embodiment, the lock assembly 19 is used to removably lock the fence pole 18 to a socket 16 that has been snugly inserted into a pre-drilled hole 14 in a pool deck 12. With the screw 24 tightened down, the snap button 20 is depressed by hand and the pole inserted into the socket 16. The pole is turned until the snap button 20 is aligned with the snap button receiving area 22 so that the snap button can snap out and lock the pole into the socket 16. Referring to FIGS. 1 and 2, when the fence pole 18 is locked to the socket 16, the lock assembly is in an engaged position, i.e., the snap button protrudes from the snap button receiving area 22 preventing the fence pole from separating from the socket.

The lock assembly 19 has two states, a locked state and an unlocked state. In the locked state, as shown in FIG. 2, the head of the screw 24 is adjacent or close to an outer surface of the fence pole 18, preventing any significant movement of the screw when a force is applied along its longitudinal axis, such as by pressing on the head of the screw. Thus, in the locked state, the pole 18 cannot be removed from the socket 16 because the snap button 20 is not accessible to be depressed. Moreover, only the screw head is visible which does not provide a visual indication to someone unfamiliar with the fence that the pole 18 can be unlocked and removed. This provides added security to the fence assembly.

In the unlocked state, as shown in FIGS. 3 and 4, the head of the screw is a sufficient distance from an outer surface of the fence pole 18 such that when an inward force is applied to the head of the screw 24 sufficient to overcome the biasing force of the supporting structure, the screw head moves toward the central longitudinal axis of the fence pole. The lock assembly 19 may be transferred between the locked and the unlocked position by rotating the screw 24 in the second hole of the connector 26 to adjust the length of the screw protruding from the fence pole 18. Thus, to unlock the fence, a tool need only be used to loosen the screw 24. The screw 24 can then be depressed by hand to allow removal of the pole from the socket 16.

As shown in FIG. 4, inward movement of the screw 24 toward the central longitudinal axis of the fence pole 18 causes the connector 26 and the snap button 20 attached to the connector 26 to also move toward the central longitudinal axis of the fence pole. Once the snap button 20 has been moved far enough such that it no longer protrudes from the snap button receiving hole 36 on the fence pole 18, the lock assembly 19 is in a disengaged position and the fence pole is separable from the socket 16. The lock assembly 19 may be transferred between the engaged position and the disengaged position by applying and releasing a longitudinal force to the screw 24. In one exemplary embodiment, the lock assembly 19 is biased into the engaged position.

While the foregoing describes exemplary embodiments of the invention, various alternatives, modifications and equivalents may be used. For instance, two or more screws could be used for extra security on the lock assembly and the size and shape of the components may vary from those described. It is also presently preferred that a tool be required to loosen the screw. However, the screw could be fitted with a wing head or otherwise configured to allow for hand loosening. This would provided added security over merely a push button release, but would be easier than requiring a tool. Moreover, it will be apparent that certain other modifications may be practiced within the scope of the appended claims.

The invention claimed is:

1. A lightweight fence or gate pole, the lightweight fence pole having a lock assembly comprising:

a base attached to the lightweight pole;

a support member extending from the base;

a connector extending from the support member, the connector having a snap button connected thereto; and a screw attached to the connector; wherein the base, the support member and the connector form a one-piece leaf spring;

wherein the lock assembly has a locked position wherein a screw head is adjacent to an outer surface of the lightweight pole; and wherein the lock assembly has an unlocked position wherein the screw head is farther away from the outer surface of the lightweight pole than in the locked position.

2. The lightweight pole of claim 1, wherein the lightweight pole is insertable into a socket, the socket being inserted into a hole.

3. The lightweight pole of claim 2, where in the socket has a snap button receiving area adapted to receive the snap button.

4. The lightweight pole of claim 1, wherein the lightweight pole is insertable into a hole in a deck surrounding a swimming pool.

5. The lightweight pole of claim 1, wherein the snap button is biased to protrude from an outer surface of the lightweight pole.

6. The lightweight pole of claim 5, wherein the lightweight pole has a snap button receiving hole from which the snap button protrudes.

7. A lightweight fence and gate comprising:

a plurality of poles;

a mesh screen tensioned between the poles having top and bottom bindings; and a gate in the fence;

wherein each pole has a lock assembly including a base attachable to the pole, a support member extending from the base, a connector extending from the support member, the connector having a snap button connected thereto, and a screw attached to the connector; wherein the base, the support member and the connector form a one-piece leaf spring;

wherein the lock assembly has a locked position wherein a base of the screw is in contact with the base of the lock assembly; and wherein the lock assembly has an unlocked position wherein the base of the screw is spaced from the base of the lock assembly.

8. The lightweight fence and gate as in claim 7, wherein the each pole is insertable into a socket, the socket being inserted into a hole.

9. A method for removing a fence pole from a socket in a lightweight fence for swimming pools surrounded by a deck, the fence pole having a lock assembly for locking the fence pole to the socket including a base attached to the lightweight fence pole, a support member extending from the base, and a connector extending from the support member, the base, the support member and the connector forming a u-shaped leaf-spring, the connector having a snap button connected thereto, the snap button protruding from an outer surface of the fence pole, and a screw attached to the connector such that a base of the screw is in contact with the base of the lock assembly, the method comprising:

using a tool to rotate the screw such that the base of the screw is spaced from the base of the lock assembly;

applying a force to the screw to cause the snap button to become flush with the outer surface of the fence pole; and disengaging the fence pole from the socket by pulling the fence pole out of the socket.

10. A lightweight fence or gate pole, the lightweight fence pole having a lock assembly comprising:

a supporting structure forming a one-piece leaf spring including a screw; and a snap button attached to the supporting structure;

wherein the supporting structure biases the snap button to protrude from an outer surface of the pole;

wherein the lock assembly has a locked position wherein a screw head is adjacent to an outer surface of the lightweight pole; and wherein the lock assembly has an unlocked position wherein the screw head is farther away from the outer surface of the lightweight pole than in the locked position.

* * * * *